United States Patent [19]

Schmid et al.

[11] Patent Number: 4,610,191

[45] Date of Patent: Sep. 9, 1986

[54] AMMUNITION CONTAINER FOR BELTED CARTRIDGES

[75] Inventors: Samuel Schmid, Dietlikon; Hans-Peter Novet, Volketswil, both of Switzerland

[73] Assignee: Werkzeugmaschinenfabrik Oerlikon-Bührle AG, Zurich, Switzerland

[21] Appl. No.: 665,531

[22] Filed: Oct. 26, 1984

[30] Foreign Application Priority Data

Nov. 4, 1983 [CH] Switzerland ..... 5955/83

[51] Int. Cl.[4] ..... F41D 10/14

[52] U.S. Cl. ..... 89/34

[58] Field of Search ..... 89/34, 33.1, 33.16; 206/3

[56] References Cited

U.S. PATENT DOCUMENTS 2,710,561 6/1955 Dowd ..... 89/34
2,874,615 2/1959 Kravik .
2,889,751 6/1959 Bilek .
3,461,774 8/1969 Maurer et al. ..... 89/34
4,393,746 7/1983 Rocha .

*Primary Examiner*—Harold D. Whitehead
*Attorney, Agent, or Firm*—Werner W. Kleeman

[57] ABSTRACT

The ammunition container is subdivided by partition walls into individual compartments. Such containers must be structured in such a manner that a cartridge belt can be easily laterally withdrawn from the container at the top thereof. For this purpose there are provided partition walls which are formed by a stationary rigid partition wall portion and a pivotable spring-type or resilient partition wall portion. The two partition wall portions are interconnected by a resilient member, such as a spring plate or leaf. Furthermore, the distance between the spring plates or leaves and the base member or floor of the container continually increases from one partition wall to the next-following partition wall in the direction towards the discharge or outlet opening of the ammunition container.

3 Claims, 3 Drawing Figures

AMMUNITION CONTAINER FOR BELTED CARTRIDGES

BACKGROUND OF THE INVENTION

The present invention relates to a new and improved construction of an ammunition container holding belted ammunition or cartridges.

In its more particular aspects, the present invention relates specifically to a new and improved construction of an ammunition container holding belted ammunition. The ammunition container is subdivided into a predetermined number of compartments or sections by pivotable partition walls and comprises an outlet or discharge opening for the belted ammunition at the upper end or in the upper end region of one side wall of the ammunition container.

In known ammunition containers of this type all of the partition walls are hinged by hinge means or pivots to a base or floor member of the ammunition container. Each partition wall comprises at its upper end a lock shaft by means of which the partition wall is locked to the side walls of the ammunition container. Each lock shaft is provided at both of its ends with so-called ball locks which latch into recesses or cut-outs in the related side walls and thereby fixedly hold the partition walls in substantially vertical position.

SUMMARY OF THE INVENTION

With the foregoing in mind it is a primary object of the present invention to provide a new and improved construction of an ammunition container holding or containing belted ammunition and which is constructed in such a manner that the withdrawal or removal of the belted ammunition is facilitated so that smaller pulling forces are required for withdrawing the cartridge belt from the ammunition container.

Another important object of the present invention is directed to the provision of a new and improved construction of an ammunition container for belted ammunition by means of which the danger is significantly reduced that the layers of the cartridge belt will mutually obstruct their withdrawal from the ammunition container.

Now in order to implement these and still further objects of the invention, which will become more readily apparent as the description proceeds, the ammunition container of the present development is manifested by the features that, each one of the partition walls comprises a stationary rigid partition wall portion and a pivotable spring-type or resilient partition wall portion. The partition wall portions are interconnected by means of resilient members, such as spring plates or leaves, and the distances between the spring plates or leaves from the base or floor member of the container continually increase from one partition wall to the next-following or subsequent partition wall in a direction towards the discharge or outlet opening of the ammunition container.

The inventive construction of the ammunition container has the following advantages:

(i) In all instances it is not the entire partition wall, but only the upper portion thereof or the spring-type or resilient partition wall portion which is pivoted, and consequently there is less danger that the zig-zag or serpentine arranged layers of the cartridge belt will become entangled and mutually obstruct their withdrawal from the ammunition container.

(ii) By means of the spring plates or leaves the result is achieved that the partition walls are not suddenly thrown over or tilted, but are slowly brought into an inclined position by means of the cartridge belt as the same is withdrawn from the ammunition container.

(iii) Since only portions of the partition walls are pivotable and not the entire partition walls, such pivotable portions of the partition walls are less heavily loaded by the ammunition or related parts or sections of the cartridge belt, and thus, must only absorb comparatively smaller forces.

(iv) The stepped arrangement of the spring plates or leaves or equivalent resilient structure enables the formation of inclined guide means or guides along which the belted cartridges can be relatively easily withdrawn from the ammunition container.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
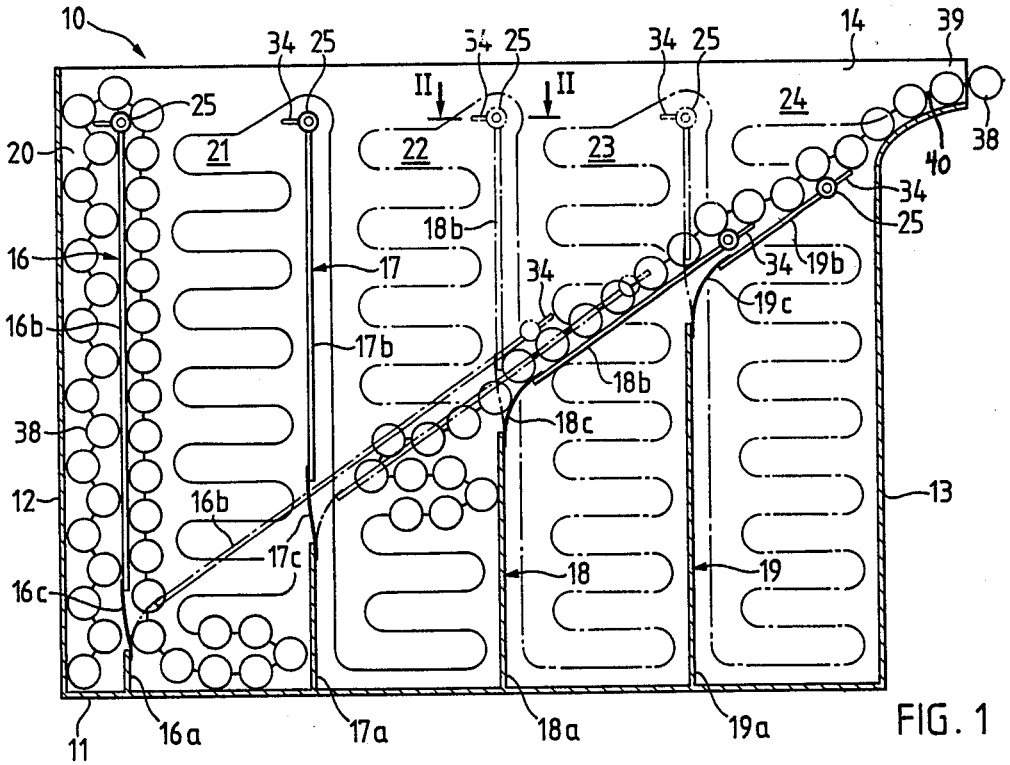
FIG. 1 is a vertical section through an ammunition container according to the invention.

Describing now the drawings, it is to be understood that only enough of the structure of the ammunition container has been shown as needed for those skilled in the art to readily understand the underlying principles and concepts of the present development, while simplifying the showing of the drawings. Turning attention now specifically to FIG. 1, there has been illustrated a vertical section through an exemplary embodiment of the inventive ammunition container 10 which comprises a base or floor member 11, four side walls 12 to 15, see also FIG. 2, and a predetermined number of partition walls 16 to 19 which subdivide the ammunition container 10 into a predetermined number of compartments or sections 20 to 24. Such general construction of the ammunition container 10 is of conventional type.

In accordance with the invention, however, the illustrated ammunition container 10 differs from known constructions of ammunition containers of this type in that here all of the partition walls 16 to 19 are subdivided into related lower, stationary partition wall portions, such as the rigid partition wall portions **16*a* to 19*a* and related spring-type or resilient or resiliently mounted partition wall portions 16*b* to 19*b*. Related spring plates or leaves 16*c* to 19*c* interconnect the stationary rigid partition wall portions 16*a* to 19*a* and the associated resilient partition wall portions 16b to 19b. The stationary partition wall portions 16a to 19a are rigidly installed in the ammunition container 10. The resilient partition wall portions 16b to 19b are pivotable about the related spring plates or leaves 16c to 19c. It is essential in this construction that the spring plates or leaves 16c to 19c do not all have the same distance from the base or floor member 11 of the ammunition container 10 but, according to FIG. 1, such spring plates or leaves 16c to 19c are continually further spaced from the base or floor member 11 as seen in a direction from the left towards the right of the ammunition container 10 i.e. in the direction of the ammunition discharge or outlet opening 39. The resilient partition wall portions 16b to 19b thus arrive, as a result of their pivoting or tilting movement in an inclined plane which approximately constitutes a diagonal plane extending through the ammunition container 10**.

Figure 2:
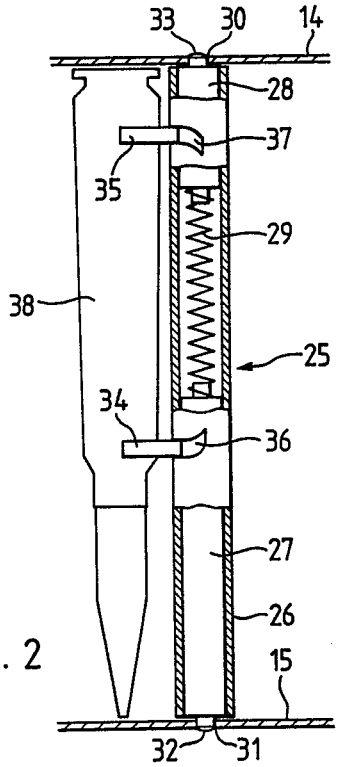
FIG. 2 is a section along the line II—II in FIG. 1 and shows one of a number of lock shafts which are provided in the ammunition container shown in FIG. 1, and each of which lock shafts is associated with a related one of the partition walls for positionally locking the same.
Figure 3:
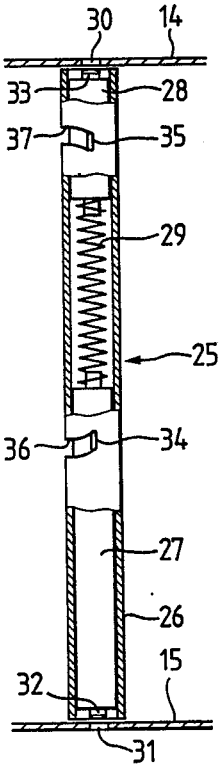
FIG. 3 is a section, similar to FIG. 2, showing the lock shaft in an unlocking position where the related resilient wall portion of the associated partition wall is free to move or tilt.

At the upper end or end region of each one of the resilient partition wall portions 16b to 19b there is mounted a related locking device, here shown as a lock shaft 25 comprising a sleeve 26, see FIGS. 2 and 3. Two latching bolts 27 and 28 are displaceably mounted in this sleeve 26 and a spring 29 is located between these two latching bolts 27 and 28. This spring 29 tends to urge the two latching bolts 27 and 28 away from each other and towards the side walls 14 and 15 of the ammunition container 10. Each one of the side walls 14 and 15 contains a passage or through-bore 30 and 31, respectively, into which a related latching pin 32 and 33 of the related bolt 27 and 28 is pushed under the force of the spring 29. The lock shaft 25 and thereby the associated one of the resilient partition wall portions 16b to 19b at which the lock shaft 25 is mounted are thus positionally secured against any pivoting movement.

At each one of the latching bolts 27 and 28 there is further mounted a related one of two unlocking members, here shown as unlocking levers 34 and 35 which protrude through related helically-shaped slots or cam structures 36 and 37 in the sleeve 26. These unlocking levers 34 and 35 are capable of assuming a locking and an unlocking position and can be pivoted, under the action of one of a plurality of cartridges 38 which are mounted at a belt generally indicated by the reference character 40 in FIG. 1, from their locking position shown in FIG. 2 to their unlocking position shown in FIG. 3. Due to such pivoting movement of the unlocking levers 34 and 35 in the associated helically-shaped slots 36 and 37, the related latching bolts 27 and 28 and the latching pins 32 and 33 associated therewith are displaced from the locked or latched position shown in FIG. 2 into the unlocked or delatched position shown in FIG. 3. As a result thereof the related resilient partition wall portions 16b to 19b can be pivoted or tilted. The two different positions of the one unlocking lever 34 is particularly evident from the showing of FIG. 1.

Belt cartridges 38 are located in the compartments or sections 20 to 24 and such cartridges 38 are withdrawn from the discharge or outlet opening 39, which is located in the upper end region of the side wall 13 of the ammunition container 10, in conventional manner and supplied to a not particularly illustrated firing weapon. These belted cartridges or rounds 38 are filled into the ammunition compartments or sections 20 to 24 in conventional manner in zig-zag or serpentine layers, as schematically shown in FIG. 1.

The mode of operation of the inventive ammunition container 10 as described hereinbefore is as follows:

When cartridges 38 or the cartridge belt 40 are withdrawn or removed through the discharge or outlet opening 39 of the ammunition container 10, there is firstly completely emptied the compartment or section 24. During the withdrawal of the cartridge belt 40 from the adjacent compartment or section 23 the unlocking levers 34 and 35 at the resilient or spring-type partition wall portion 19b are pivoted under the action of one of the cartridges 38 carried by the cartridge belt 40 in the manner as illustrated in FIGS. 2 and 3. The associated lock shaft 25 is thereby unlocked. Due to the weight of the cartridges 38 carried by the belt 40 which acts upon the partition wall 19 as the belt 40 is further withdrawn Through the discharge or outlet opening 39, the resilient partition wall portion 19b is tilted from the vertical position towards the right into an inclined position as will be evident from FIG. 1. In analogous manner the remaining resilient partition wall portions 16b to 18b are also pivoted or tilted towards the right as the related ammunition compartments or sections 20 to 23 are successively emptied. The spring plates or leaves 16c to 19c form round or curved portions during the pivoting of the resilient partition wall portions 16b to 19b. Such rounded or curved portions substantially facilitate the removal of the belted cartridges or rounds 38. After all the compartments or sections 20 to 24 have been emptied, all of the partition walls 16 to 19 can pivot back into their original essentially vertical position under the spring action of the spring plates or leaves 16c to 19c.

While there are shown and described present preferred embodiments of the invention, it is to be distinctly understood that the invention is not limited thereto, but may be otherwise variously embodied and practiced within the scope of the following claims.

Accordingly, what we claim is:

1. An ammunition container for belted cartridges, comprising:

a base member and a predetermined number of side walls;

a discharge opening for the belted cartridges provided in one of said side walls in an upper end region thereof;

a predetermined number of pivotable partition walls subdividing said ammunition container into a predetermined number of compartments;

each said pivotable partition wall comprising:

a stationary rigid partition wall portion;

a pivotable resilient partition wall portion pivotable toward said discharge opening;

a spring plate interconnecting said stationary rigid partition wall portion and said pivotable resilient partition wall portion;

each one of said spring plates being arranged at a predetermined distance from said base member of the ammunition container;

said predetermined distances of said spring plates from said base member of the ammunition container continually increasing from one pivotable partition wall to a subsequent pivotable partition wall in a direction towards said discharge opening; and means for locking said pivotable partition wall portion in an upright position and being operated by one of said belted cartridges to release said pivotable partition wall portion.

2. The ammunition container as defined in claim 1, wherein said means for locking comprises:

a predetermined number of lock shafts each of which is mounted at a related one of said predetermined number of pivotable partition walls;

each one of said predetermined number of lock shafts comprising two unlocking levers; and each one of said two unlocking levers being capable of assuming a locking position and an unlocking position and being pivoted by one of said belted cartridges from said locking position into said unlocking position.

3. An ammunition container for belted cartridges, comprising:

a base member and a predetermined number of side walls;

a discharge opening for the belted cartridges provided in one of said side walls in an upper end region thereof;

a predetermined number of partition walls subdividing said ammunition container into a predetermined number of compartments;

each said partition wall comprising:

a stationary partition wall portion;

a pivotable partition wall portion pivotable toward said discharge opening;

a resilient member interconnecting said stationary partition wall portion and said pivotable partition wall portion;

each one of said resilient members being arranged at a predetermined distance from said base member of the ammunition container;

the respective predetermined distance of each said resilient member from said base member of the ammunition container increasing from one partition wall to a subsequent partition wall in a direction towards said discharge opening; and means for locking said pivotable partition wall portion in an upright position and being operated by one of said belted cartridges to release said pivotable partition wall portion.

* * * * *